US005129663A

United States Patent [19]

Soo

[11] Patent Number: 5,129,663

[45] Date of Patent: Jul. 14, 1992

[54] ROLLER/ICE SKATE BASE

[76] Inventor: Mike Soo, No. 403, Chung Shan Rd., Jen Teh Hsiang, Tainan Hsien, Taiwan

[21] Appl. No.: 629,531

[22] Filed: Dec. 18, 1990

[51] Int. Cl.[5] ..... A63C 17/18

[52] U.S. Cl. ..... 280/7.14; 280/11.22

[58] Field of Search ..... 280/11.22, 11.23, 7.13, 280/7.14, 11.18

[56] References Cited

U.S. PATENT DOCUMENTS

| | | | |
|---|---|---|---|
| 480,610 | 8/1892 | Nielson | 280/11.22 |
| 1,530,211 | 3/1925 | Siemnash | 280/11.22 |
| 2,377,366 | 6/1945 | Paystrup | 280/11.23 |
| 4,603,868 | 8/1986 | Schutz | 280/11.22 |

*Primary Examiner*—David M. Mitchell

*Attorney, Agent, or Firm*—Townsend and Townsend

[57] ABSTRACT

A roller/ice skate base includes an upper structure for attaching a skate boot thereon and having two side walls integral therewith for receiving a plurality of wheels or a lower structure with a fixed ice blade therebetween. The upper structure includes a plurality of spaced square recesses formed on an outer surface of each side wall. Each recess has a corresponding boss protruding from an inner surface of each side wall. Each boss has a round hole extending from the inner surface of the side wall to an inner surface of each corresponding recess. The lower structure includes a number of holes corresponding to the square recess. Each hole has a U-shaped recess formed on each side thereof, each U-shaped recess receiving a boss therein when the lower structure is received by the upper structure.

1 Claim, 4 Drawing Sheets

ROLLER/ICE SKATE BASE

BACKGROUND OF THE INVENTION

The present invention relates to a roller/ice skate base, and more particularly to a skate base to which either a plurality of wheels or an ice blade can be attached.

Applicant's U.S. patent application Ser. No. 06/849,386, which has been abandoned, disclosed a skate which could be used as an ice skate or roller skate. U.S. Pat. No. 4,603,868 discloses a roller skate undercarriage with adjustable rollers. Generally, an ice blade or a plurality of wheels is fixed on the roller/ice skate base by bolts and nuts. However, converting an ice skate into a roller skate or converting a roller skate into an ice skate by this method is cumbersome and time-consuming as the bolts tend to turn while loosening the nuts.

Furthermore, recent innovations have significantly changed the conventional idea of roller skates. Modern roller skates, i.e., rollerblade-type skates, have wheels which are substantially wider than an ice blade. Therefore, in order to accommodate the size of wheels which a popularly used today, the width of the slot in the base of the skate has to be substantial. Meanwhile, ice blades have remained substantially the same width. Therefore, when employed with a roller skate used today, a modification is necessary to eliminate any unstable attachment and to prevent wobbling of the blade and so on.

The present invention provides an improved roller-/ice skate base to obviate and/or mitigate the above-mentioned problems.

SUMMARY OF THE INVENTION

It is an object of the present invention to provide an improved roller/ice skate base having a lower structure for fixing an ice blade thereto having a plurality of bosses and compatible U-shaped recesses for providing stable support.

It is another object of the present invention to provide an improved roller/ice skate base having square recesses to prevent the bolts from turning while fastening and unfastening.

These and additional objects, if not set forth specifically herein, will be readily apparent to those skilled in the art from the detailed description provided hereunder, with appropriate reference to the accompanying drawings.

DETAILED DESCRIPTION OF THE PREFERRED EMBODIMENTS

Figure 1:
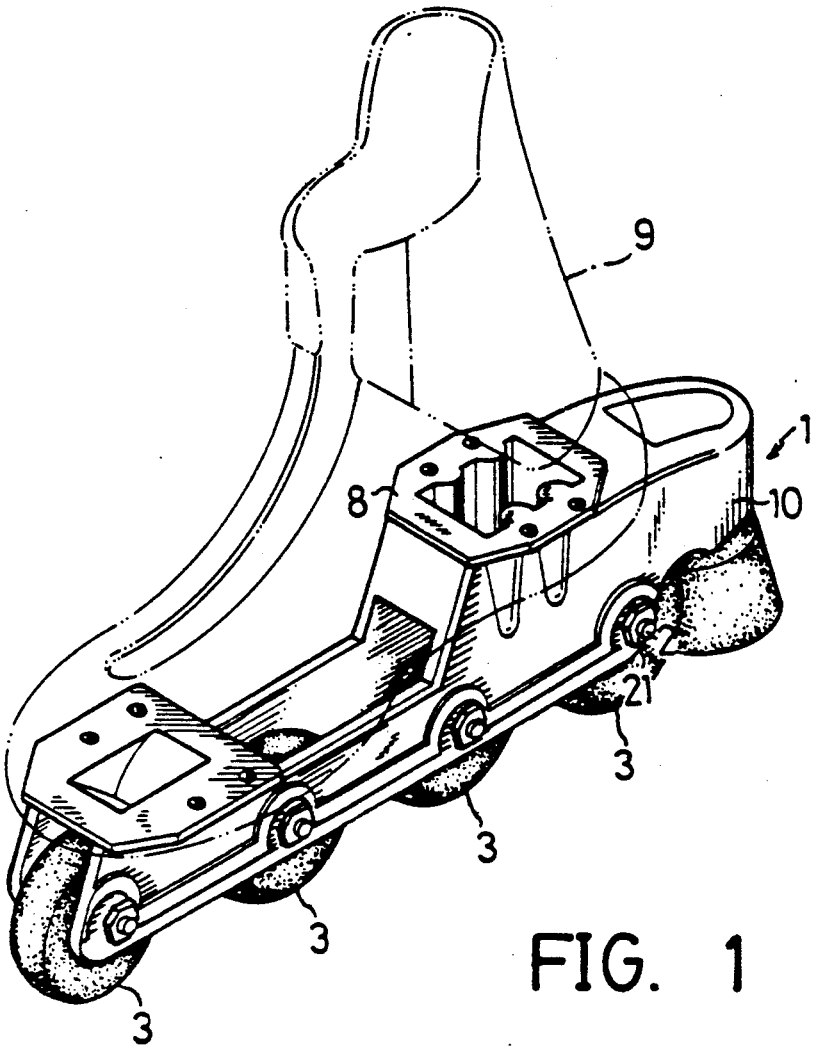
FIG. 1 is a perspective view of a roller/ice skate base in accordance with the present invention, in which the skate base is equipped with wheels to serve as a roller skate.
Figure 2:
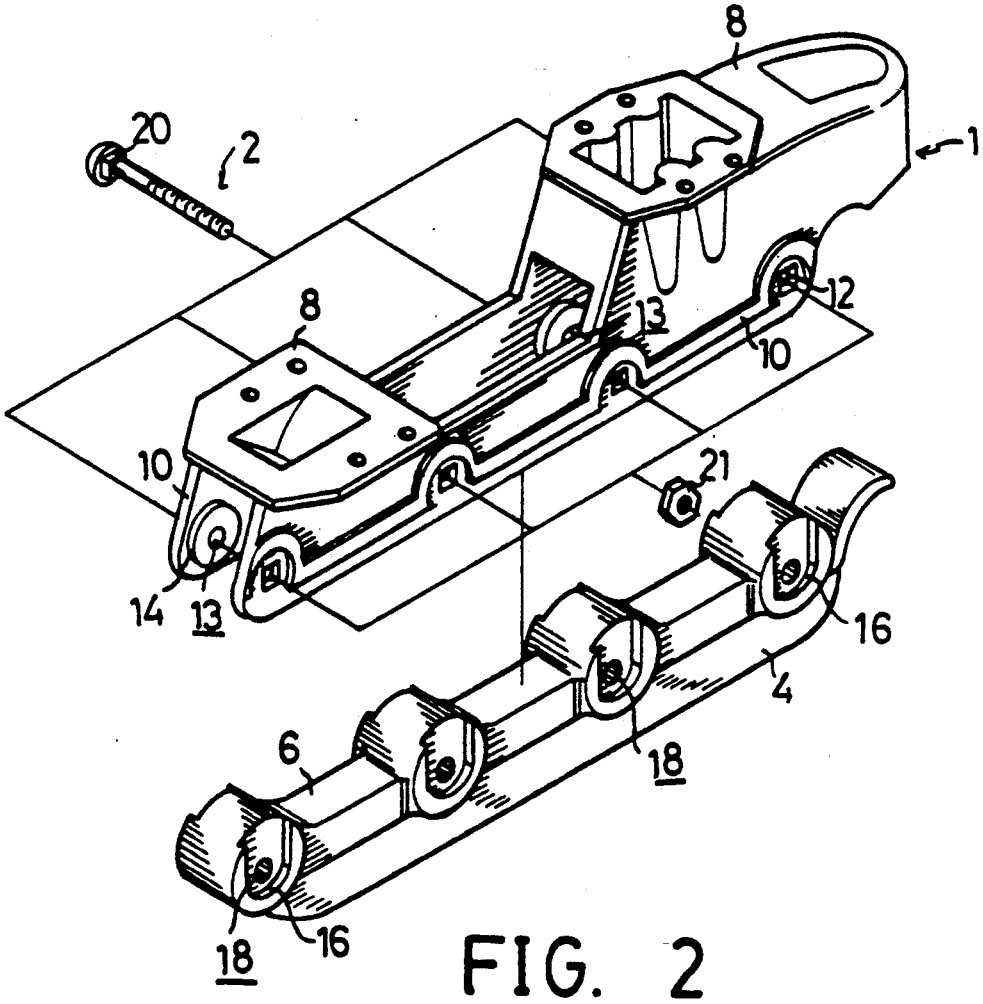
FIG. 2 is a perspective exploded view of the roller-/ice skate base and an ice blade, particularly showing a lower structure to which the ice blade is fixed.

Referring to the drawings, and initially to FIGS. 1 and 2, a roller/ice skate base 1 is shown in a preferred embodiment in accordance with the present invention and conventionally comprises a plurality of fixing means 2, such as nuts and bolts, which attaches a plurality of singular wheels 3 or an ice blade 4 fixed in a lower structure 6 (not conventional) to an upper structure 8 to which a skate boot 9 attaches.

Figure 5:
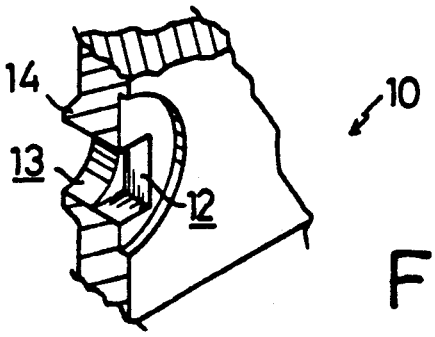
FIG. 5 is a partial cut-away view showing a structure of a side wall of the present roller/ice skate base.

The upper structure 8 comprises a pair of parallelly-spaced side walls 10 integral therewith. Each side wall 10 has a plurality of spaced square recesses 12 formed on an outer surface thereof around a plurality of holes 13, and has a plurality of bosses formed on an inside surface thereof around the plurality of holes 13. FIG. 5 clearly shows the corresponding relationship between the square recesses 12, the holes 13, and the bosses 14.

Figure 3:
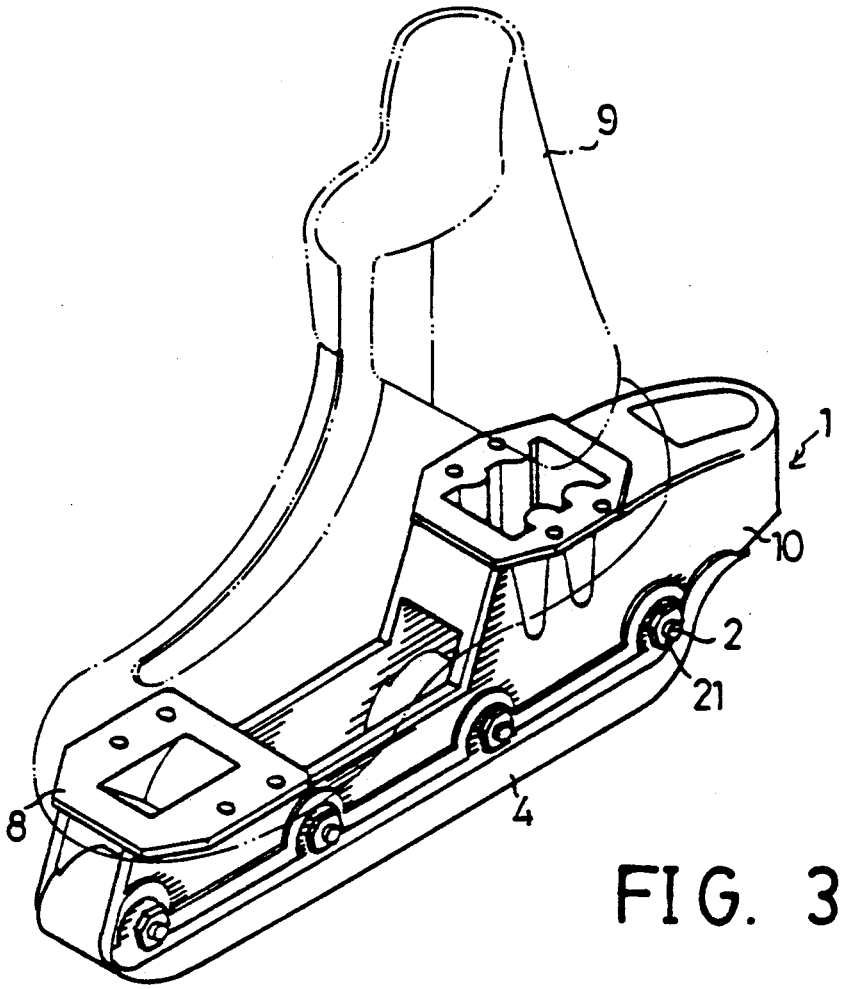
FIG. 3 is a perspective view of an assembled ice skate utilizing the present roller/ice skate base.
Figure 4:
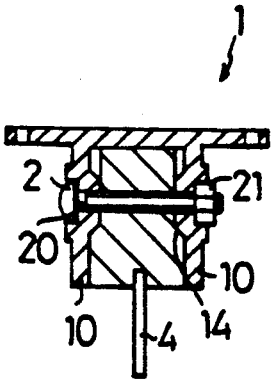
FIG. 4 is a cross-sectional view showing an assembly of the ice skate and the present roller/ice skate base.

The lower structure 6 comprises a plurality of U-shaped recesses 16 formed on both sides thereof and a plurality of through holes 18 positioned within the U-shaped recesses 16. The U-shaped recesses 16 are dimensioned so as to receive the bosses 14 without a substantial tolerance therebetween, thereby the lower structure 6 is securely received between the side walls 10 of the upper structure 8. The provision of the U-shaped recesses 16 and the bosses 14 prevents longitudinal movement of the lower structure 6 within the upper structure. FIG. 4 clearly shows this engagement in a cross-section, with the bolt 20 having a square portion on an underside of the head thereof received in the square recesses 12, with a nut 21 securing at the opposite end. Also from this figure it can be seen that the ice blade 4 is securely fastened to the base 1, even though the distance separating the side walls 10 is much greater than the width of the ice blade 4. FIG. 3 presents a perspective view of this embodiment.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. In a combination of a roller/ice skate base and an ice blade structure, said roller/ice blade base comprising an upper structure for attaching a skate boot thereto and said ice blade structure comprising a lower structure for fixing an ice blade thereto;

said upper structure comprising a pair of parallelly-spaced side walls, each said side wall comprising a plurality of spaced first through holes, each said first through hole having a square recess formed therearound on an outer surface of said side wall; each said side wall further comprising a plurality of bosses, each boss being formed on an inside surface thereof around each said first through hole;

said lower structure comprising a plurality of spaced second through holes corresponding to said first through holes of said side walls and a plurality of U-shaped recesses being formed around said second through holes on outer sides of said lower structure;

said lower structure being receivable between said side walls with said U-shaped recesses receiving said bosses, thereby aligning said through holes of said upper and lower structures to receive a bolt therethrough with said square recesses receiving compatible square portions of the bolts.

* * * * *